US005828761A

United States Patent [19]

Langer

[11] Patent Number: 5,828,761

[45] **Date of Patent: *Oct. 27, 1998**

[54] SOUND AMPLIFICATION SYSTEM HAVING A SUBMERSIBLE MICROPHONE

[76] Inventor: Alexander G. Langer, 22942 Captain Kidd La., Cudjoe Key, Fla. 33042

[ * ] Notice: The term of this patent shall not extend beyond the expiration date of Pat. No. 5,627,802.

[21] Appl. No.: 492,412

[22] Filed: Jun. 19, 1995

[51] Int. Cl.[6] ..... H04R 1/02

[52] U.S. Cl. ..... 381/91; 381/122; 367/162; 367/167; 367/172; 367/176; 367/188

[58] Field of Search ..... 381/122, 28, 77, 381/80, 81, 84, 87, 88, 91, 111, 112, 113, 114, 115; 367/162, 167, 172, 176, 188

[56] References Cited

U.S. PATENT DOCUMENTS

| | | | |
|---|---|---|---|
| 3,284,406 | 11/1966 | Nelson . | |
| 3,382,598 | 5/1968 | Wilson | 43/17 |
| 4,013,992 | 3/1977 | Dewberry et al. . | |
| 4,074,224 | 2/1978 | Laurent . | |
| 4,110,727 | 8/1978 | Kriege . | |
| 4,225,970 | 9/1980 | Jaramillo et al. | 455/89 |
| 4,437,255 | 3/1984 | Reed | 43/17 |
| 4,769,795 | 9/1988 | Massa et al. | 367/157 |
| 4,805,339 | 2/1989 | Fuentes et al. | 43/42.31 |
| 5,117,403 | 5/1992 | Eberl et al. | 367/175 |
| 5,627,802 | 5/1997 | Langer | 367/188 |

*Primary Examiner*—Forester W. Isen
*Attorney, Agent, or Firm*—Weingarten, Schurgin, Gagnebin & Hayes LLP

[57] ABSTRACT

A sound amplification system includes an amplifier and a waterproof microphone. In an exemplary embodiment the microphone includes a transducer within a cavity covered by a resilient waterproof membrane. The system can monitor either the complete frequency range of the microphone or only one or more selected frequency ranges. The system can include one or more noise emitting lures that produce sound in a frequency range corresponding to the one or more selected frequency ranges. The invention also includes a method of waterproofing a miniature microphone.

16 Claims, 4 Drawing Sheets

SOUND AMPLIFICATION SYSTEM HAVING A SUBMERSIBLE MICROPHONE

FIELD OF INVENTION

The present invention relates to sound amplification, and more particularly to a sound amplification system having a submersible microphone.

BACKGROUND OF INVENTION

Devices are known for helping sport and commercial fisherman detect fish. One such device is a sonar transducer. Sonar transducers bounce sound waves off the sea bottom for detecting fish and other underwater objects, and provide a graphical output to a sophisticated monitor by use of heavy shielded cables. Fisherman must constantly watch the monitor for signs of underwater activity. This can be a time consuming chore and a distraction from the ultimate goal of catching fish.

Sonar transducers respond to the reflection of sound waves, and therefore must be fixed to the bottom of a ship or boat, or hung from the side of the boat to direct sound waves towards the sea bottom. The transducers along with a pre-amplifier are normally encased within hard rubber or plastic to form a waterproof enclosure, which adds to the size and weight of these devices. Due to the sophistication and complexity of these devices, they need to draw power off of the power supply of a ship or boat. This requires extensive time and labor to outfit a boat for and install these devices. On large boats, mounting of the transducer can require a diver to perform underwater installation or it can require the boat to be hauled out of the water for the work to be accomplished in dry dock.

The monitors associated with sonar transducers can take up large amounts of precious console space, which can be especially troublesome on small boats with limited room. Making room for the monitor is not an easy task; it may involve moving other electronic devices on the boat due to interfering signals, or adding housings to the boat for placement and separation of specific electronics.

Another type of acoustic device for detecting underwater activity is a hydrophone, which is generally no smaller than a fist. These devices are normally used for research expeditions, and are used in highly complex electronic systems. Hydrophones, like sonar transducers use large shielded cables, and are generally encased with a pre-amplifier in hard rubber or plastic to form a waterproof enclosure, which adds to the size and weight of these devices. Due to the size, weight, and cable requirements, hydrophones cannot be cast or attached to a fishing line or lure. They have limited mobility and are usually suspended from the side of a boat.

Hydrophones are also normally associated with sophisticated and expensive power amplifiers that are capable of amplifying specific frequencies and tones for detailed analysis of underwater activity. These power amplifiers are generally large and expensive, requiring tabletop space and use of a ship's power supply. The combination of large hydrophones, heavy cables and large power amplifiers, limits the portability of a hydrophone system. Even though hydrophone systems might be suitable for researchers, oceanographers, or some commercial fisherman, they are totally unsuitable for a sport fisherman.

Sport fisherman could benefit from a lightweight portable device that could help in the detection of underwater activity. A device that allows a fisherman, while fishing, to freely move about a boat without requiring constant monitoring of electronic equipment would be particularly advantageous. Small boat owners could additionally benefit from an underwater activity detection system that does not require precious boat space to be consumed. But presently no low cost, simple, small, lightweight, low power, easily operated device exits capable of detecting underwater activity of lures and fish, both near and far from a boat or shore.

SUMMARY OF THE INVENTION

The present invention overcomes the above disadvantages by providing a sound amplification system that includes a submersible miniature microphone and a high output amplifier. The amplifier, which can be no larger than a pack of cigarettes, can be easily carried or worn by a fisherman without being an encumbrance. The system allows for monitoring of underwater acoustic activity, such as fish or lure sounds, to increase the situational awareness of the fisherman. The microphone, which is generally much smaller than a lure, can be easily cast while attached to the end of a fishing line along with the lure or placed into the water independently therefrom. A second waterproof microphone can be added to the system for binaural monitoring of underwater activity. The system can further include a noise emitting lure and a frequency selection device that is tunable to the frequency emission range of the lure.

An important feature of the system is the waterproof coating on the microphone which allows it to be submersible while not substantially interfering with its operation. In an exemplary embodiment the coating includes a resilient polymer. A method of waterproofing a microphone is disclosed in which a microphone is dipped in a waterproof substance, retained in the substance for a predetermined time duration, removed from the substance, and dried.

BRIEF DESCRIPTION OF THE DRAWINGS

The invention will be more fully understood by reference to the following detailed description when considered in conjunction with the accompanying drawings, in which.

DETAILED DESCRIPTION OF THE INVENTION

Figure 1:
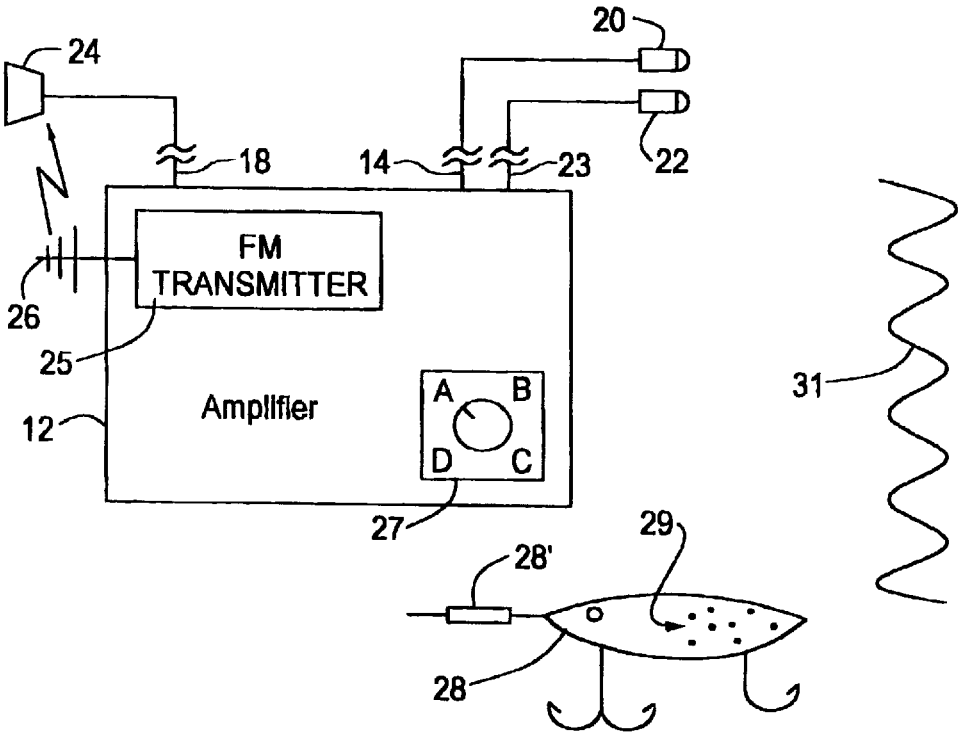
FIG. 1 is a diagram of the sound amplification system having a submersible microphone.

FIG. 1 is an illustration of a sound amplification system in accordance with the present invention. The sound amplification system includes an amplifier 12 having an input 14, and an output 18. The system further includes a submersible microphone 20 in communication with the input 14. A second submersible microphone 22 can be provided for connection to a second input 23 of the amplifier 12. The second input 23 and the second submersible microphone 22, when included as shown in FIG. 1, form a stereophonic embodiment of the present invention described in greater detail with respect to FIGS. 4 and 5.

A speaker 24, such as headphones or an FM headset, can be connected to the output 18 of the amplifier 12 to provide a system for a single user. However, a loudspeaker can be connected to the output 18 of the amplifier 12 to allow multiple users to listen to the detected underwater acoustic activity. In yet another embodiment for single or multiple users, the amplifier is provided with an FM transmitter 25 and an antenna 26 for transmitting the output of the amplifier to a loudspeaker or one or more FM headsets (an FM receiver and one or more speakers). In still another embodiment, the amplifier 12 and headphones can be waterproofed to create a completely submersible system.

The system can include an amplifier 12 having a frequency range selection device 27 that allows the operator to select a predetermined frequency range, represented by letters A–D, that the operator wishes to monitor. The device 27 can be mechanically or electronically actuatable, and can include any number of selectable frequency ranges.

Although the system provides the ability to detect and monitor underwater acoustic activity, the ability to select and monitor a particular frequency range known to be associated with a particular object allows the operator to screen-out potentially distracting or incidental noises. The advantages provided by the frequency range selection device 27 are particularly noticeable when the system further includes a sound emitting lure 28, or a sound emitter 28', that produces sound in a known frequency range that corresponds to a preset frequency range. For example, the system can be provided as a kit including the amplifier 12, speaker 24, microphone 20, and one or more sound emitting lures 28. In an exemplary kit, lures A–D are provided, wherein each of the lures produces a sound corresponding to the preset values of the frequency range selection device 27.

The lure 28 or sound emitter 28' can produce sound either mechanically or electronically. For example, a lure 28 can include a hollow cavity in which one or more small solid objects 29 are loosely retained so that movement of the lure causes the objects to rattle within the cavity to produce a sound. When the lure 28 is manipulated by the fisherman in a particular manner, a cadence can be established producing a readily identifiable sound emission 31 from the lure 28. Even if a gentle fish strike does not interrupt the cadence sufficiently to provide tactile feedback, aspiration of the lure by a fish will cause a noticeable change in the sound emitted by the lure, instantly signaling a strike which would otherwise be undetectable.

Figure 2:
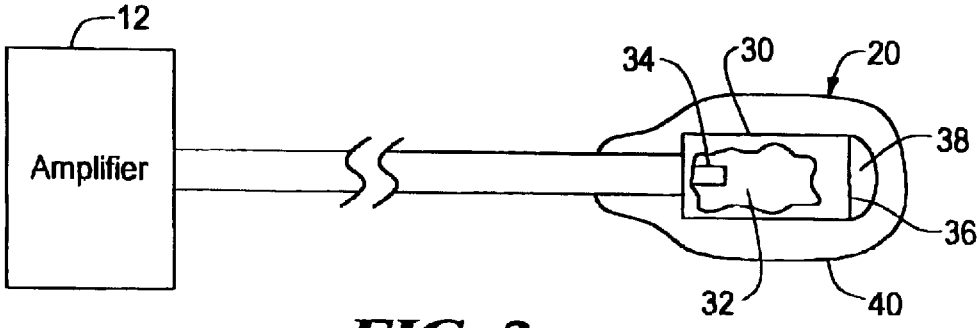
FIG. 2 is a detailed view of the submersible microphone of the system of FIG. 1.

Referring now to FIG. 2, a detailed illustration of the submersible microphone 20 of FIG. 1 is shown. The second submersible microphone 22 can be substantially identical to the first submersible microphone 20, and therefore will not be separately described. The microphone 20 includes a housing 30 having a cavity 32 for a transducer 34 in communication with the amplifier 12. The housing 30 further includes an opening 36 for access to the cavity 32 of the housing 30. The opening 36 of the housing 30 is covered by a sound permeable or acoustically transparent covering 38, such as felt. The entire microphone 20 is coated with a waterproof substance to provide a resilient or flexible membrane 40, shown in exaggerated proportion in FIG. 2, that resonates in response to acoustic activity. Alternatively, the covering 38 alone can be coated with a waterproof substance. The membrane 40 is impervious to water, yet allows underwater vibrations to cause air vibrations inside the housing 30 of the microphone 20 and thereby activate the transducer 34, without substantial interference with the microphone operations. Although the housing 30 is shown as cylindrical in this embodiment, the particular shape of the microphone is unimportant.

In an embodiment of the present invention, the waterproof membrane on the microphone can be formed by a coating process having the following steps. In the first step, an assembled miniature microphone is provided, such as Panasonic miniature microphone. A subsequent step requires the microphone to be dipped in a waterproof coating substance, such as Color Guard™ Tough Rubber Coating manufactured by Permatex Industrial Corporation of Connecticut. Prior to dipping, the tiny bubbles which could interfere with the sound transmission properties of the membrane can be minimized by agitation or application of a vacuum in a debubbling step. When the coating is Color Guard™ Tough Rubber Coating, it must be diluted with a thinner to achieve optimal frequency response. In other words, if the coating is too thick, the sound is deadened. A 1:1 mixture of thinner and coating provides excellent results, however, a mixture range of 3:1 to 1:3 also provides acceptable results.

In an exemplary embodiment, the microphone is dipped into the coating at a downward rate of approximately ½ inch per second. After stopping on the downward stroke, the microphone is retained in the waterproof coating substance for approximately one second. The microphone is removed, in a further step, from the waterproof coating substance at approximately the same rate of speed the microphone was dipped. In a later step, the waterproof coating substance then undergoes a drying process. In the drying process, the microphone is placed with the covering 38 pointing substantially upwards so that the waterproof coating substance is stretched across the covering 38. The covering 38 prevents the waterproof coating substance from entering the cavity 32 of the microphone, while at the same time allowing the coating to form a waterproof membrane 40. The coating is allowed to dry for three or more hours.

Microphones having cords already attached electrically can be dipped as a single unit, so that the cord and microphone interface are covered. Thus, the entire microphone, cords and electrical connections can be sealed into a single waterproof unit. This single waterproof unit can seal the microphone from damaging elements. For example, in salt water, the waterproofing can protect any metal components of the microphone and any wires included with the microphone from being damaged by the effects of galvanic corrosion.

In another embodiment of the invention, the cavity defined by the microphone housing 30 can be pressurized to above one atmosphere. In yet another embodiment the microphone housing 30 can be filled with a fluid, such as oil, to enhance acoustic performance within the cavity. Namely, the fluid inside the housing acts as a superior vibration conductor. The fluid also provides the benefit of eliminating compressive effects related to submersion depth because fluids are substantially incompressible.

Figure 3:
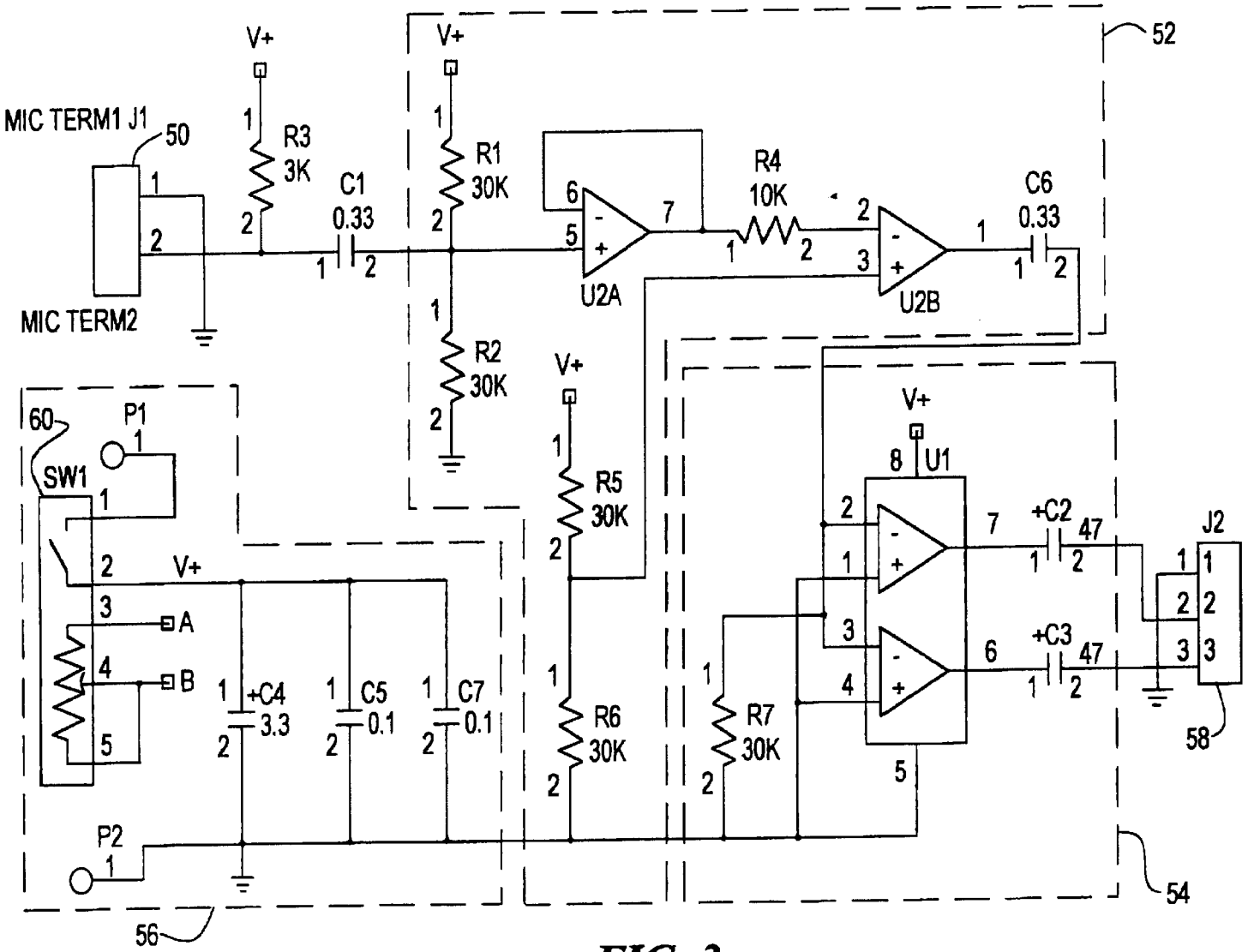
FIG. 3 is a schematic diagram of a monophonic amplifier for the system of FIG. 1.

FIG. 3 is a schematic diagram of a monophonic amplifier specifically adapted for use in the sound amplification system of FIG. 1. The monophonic amplifier has an input 50 capable of receiving a communication signal from the microphone 20, a pre-amplifier 52, a power amplifier 54, a gain control 56, and an output jack 58 for a speaker 24 or headphones. The gain control 56 includes an adjustable switch 60, which is a combination on/off switch and audio tapered potentiometer that adjusts the pre-amplifier gain by a factor of zero to five. The power amplifier 54 enhances the gain of the communication signal by a factor of approximately 1000, which then drives the output jack equipment.

Figure 4:
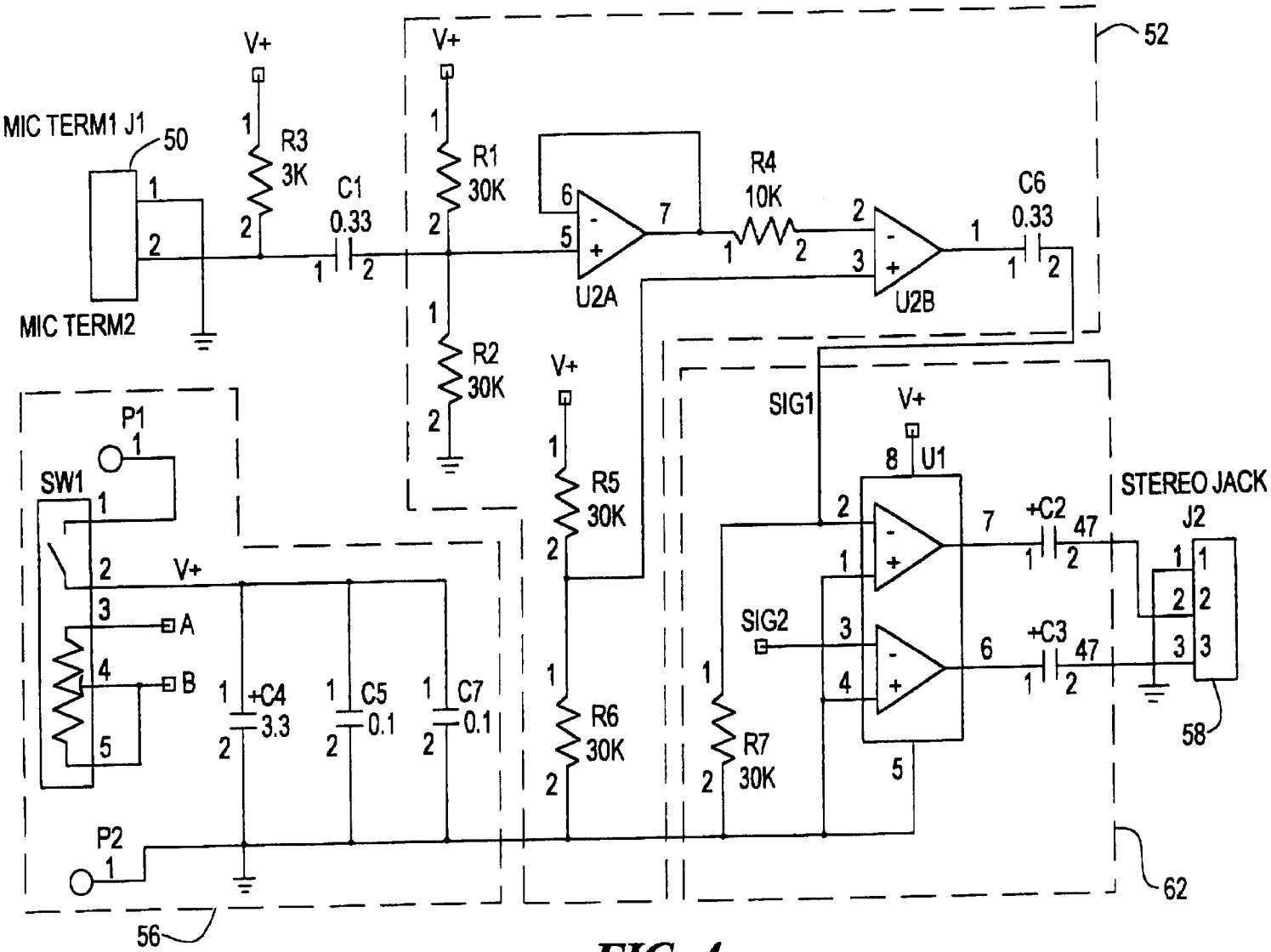
FIG. 4 is a schematic diagram of a portion of a stereophonic amplifier for the system of FIG. 1.
Figure 5:
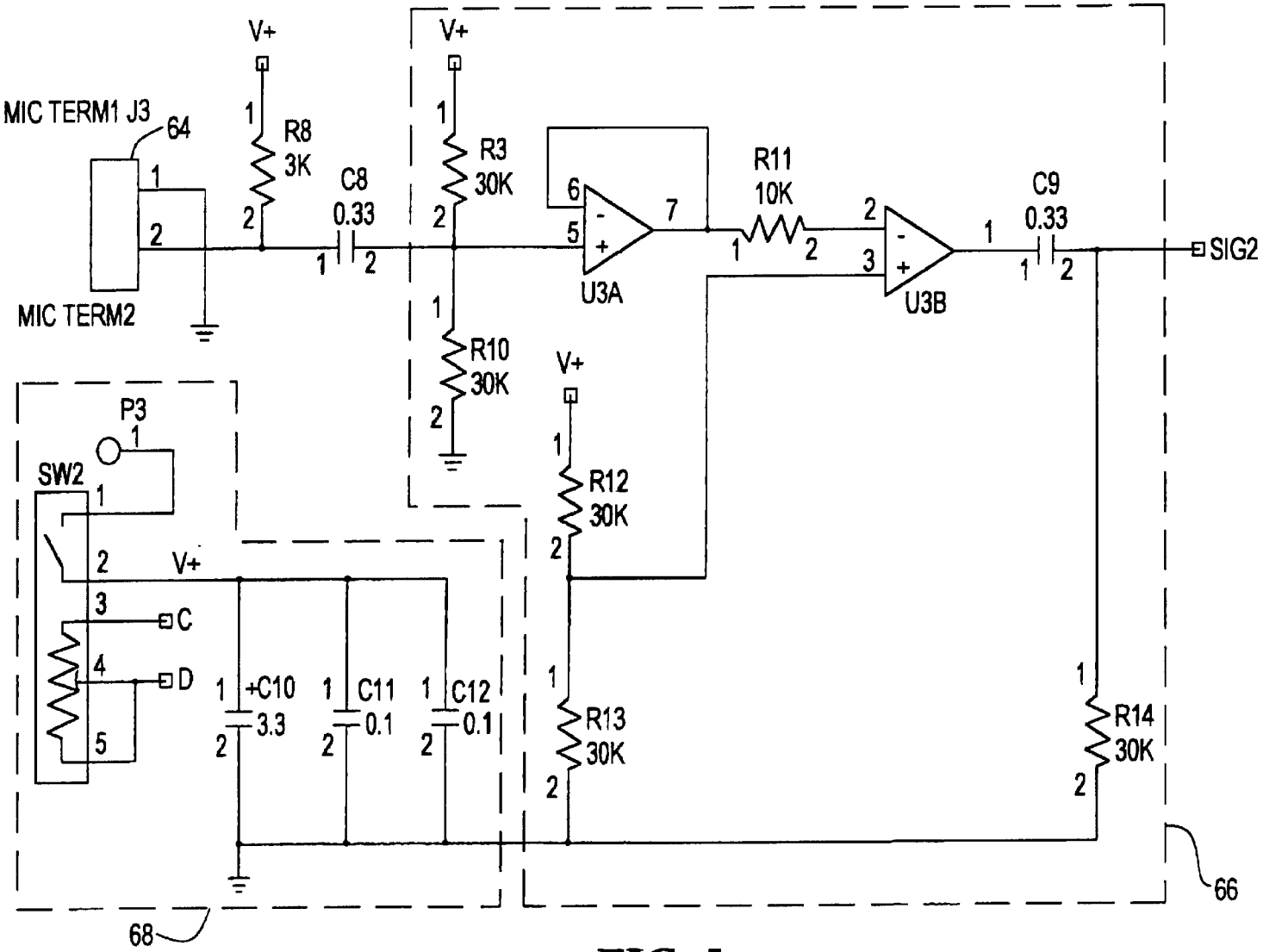
FIG. 5 is a continuation of the schematic diagram of the stereophonic amplifier of FIG. 4.

FIGS. 4 and 5, together, show another embodiment of the amplifier of the present invention. FIG. 4 is a schematic diagram of a stereophonic amplifier for use in the sound amplification system of FIG. 1. The schematic of FIG. 4 is substantially identical to the schematic of FIG. 3, with respect to the input 50, pre-amplifier 52, gain control 56, and output jack 58. FIG. 4 shows a stereophonic power amplifier 62 that receives a signal 1 and a signal 2. Signal 2 is processed via the amplification circuit shown in FIG. 5. FIG. 5 also shows a second input 64, a second pre-amplifier 66, and a second gain control 68, which all operate as discussed above with respect to FIG. 3. The second pre-amplifier 66 outputs the signal 2 to the stereophonic power amplifier 62 of the stereophonic amplifier, as shown in FIG. 4.

Although the invention has been shown and described with respect to exemplary embodiments thereof, various other changes, omissions and additions and form in detail thereof, may be made therein without departing from the spirit and scope of the invention.

What is claimed is:

1. A sound amplification system comprising:

an amplifier having an input and an output; and a submersible waterproof microphone adapted for communication with said input of said amplifier while said microphone is exposed to water, said microphone including a housing defining a cavity, an opening for accessing said cavity, a sound permeable material covering said opening, and a deflectable waterproof membrane responsive to acoustic activity covering said sound permeable material and said opening.

2. The sound amplification system of claim 1, wherein said sound permeable material includes felt.

3. The sound amplification system of claim 1, wherein said waterproof membrane includes a resilient polymer.

4. The sound amplification system of claim 1, wherein said waterproof membrane comprises a rubber coating.

5. The sound amplification system of claim 4, wherein said waterproof membrane comprises a rubber coating mixed with a thinner in a 3:1 to a 1:3 ratio by volume.

6. The sound amplification system of claim 1, wherein said cavity is substantially filled with a fluid.

7. The sound amplification system of claim 6, wherein said fluid includes oil.

8. The sound amplification system of claim 1, wherein said cavity is pressurized to greater than one atmosphere.

9. The sound amplification system of claim 1, wherein said amplifier includes a second input and a second microphone in communication with said second input of said amplifier.

10. The sound amplification system of claim 1, wherein said amplifier includes a frequency range selection device.

11. The sound amplification system of claim 10, further comprising one of a sound emitting lure and a sound emitter capable of producing sound in a predetermined frequency range.

12. The sound amplification system of claim 11, wherein said sound emitting lure defines a cavity loosely containing a plurality of solid objects.

13. The sound amplification system of claim 11, wherein said frequency selection device includes a selectable frequency range corresponding to said predetermined frequency range.

14. The sound amplification system of claim 1, further including a speaker in communication with said output of said amplifier.

15. The sound amplification system of claim 14, said amplifier further including an FM transmitter for broadcasting said output of said amplifier and wherein said speaker includes an FM receiver for receiving said broadcast output.

16. A sound amplification system comprising:

an amplifier having an input and an output;

a submersible waterproof microphone adapted for communication with said input of said amplifier while said microphone is exposed to water, said microphone including a housing defining a cavity, an opening for accessing said cavity, a sound permeable material covering said opening, and a deflectable resilient waterproof membrane responsive to acoustic activity covering said sound permeable material and said opening;

a frequency range selection device including at least one selectable frequency range; and a sound emitting lure capable of producing sound in a predetermined frequency range corresponding to said at least one selectable frequency range.

* * * * *